United States Patent [19]

Mihaly

[11] 3,977,360

[45] Aug. 31, 1976

[54] APPARATUS FOR APPLYING A COATING TO THE INTERNAL WALL OF A CONDUIT

[75] Inventor: Louis C. Mihaly, Findlay, Ohio

[73] Assignee: Marathon Oil Company, Findlay, Ohio

[22] Filed: Dec. 23, 1974

[21] Appl. No.: 535,530

[52] U.S. Cl. ..... 118/408; 118/DIG. 10

[51] Int. Cl.[2] ..... B05C 7/08

[58] Field of Search .... 118/408, 105, 254, DIG. 10; 427/230; 15/104.06 R

[56] References Cited

UNITED STATES PATENTS

| | | | |
|---|---|---|---|
| 2,480,358 | 8/1949 | Curtis et al. | 118/408 |
| 3,105,554 | 10/1963 | McCall | 118/DIG. 10 |
| 3,108,024 | 10/1963 | Battle | 118/408 |
| 3,135,629 | 6/1964 | McLean | 118/408 |
| 3,216,435 | 11/1965 | Poettmann | 118/408 X |
| 3,495,546 | 2/1970 | Brown et al. | 118/408 X |
| 3,703,947 | 11/1972 | Landrum | 118/408 X |

*Primary Examiner*—John P. McIntosh
*Attorney, Agent, or Firm*—Joseph C. Herring; Jack L. Hummel

[57] ABSTRACT

A uniform, continuous layer of a drag reduction material is applied to the internal wall of a conduit by injecting into the conduit the material in liquid form via an apparatus capable of applying the liquid to the internal conduit wall. The apparatus supplies the liquid to the wall at a rate proportional to the rate of travel of the apparatus through the conduit. The drag reduction material may be injected into the conduit either prior to the injection of the apparatus or may be contained in a chamber within the apparatus.

12 Claims, 4 Drawing Figures

APPARATUS FOR APPLYING A COATING TO THE INTERNAL WALL OF A CONDUIT

BACKGROUND OF THE INVENTION

1. Field of the Invention

This invention relates to apparatus for applying a continuous layer of a liquid onto the internal wall of a conduit, e.g. a pipeline.

2. Prior Art

In the pipelining of a viscous fluid, there is a pressure drop between the upstream and downstream portions of the flowing fluid due to interactions between the fluid and the internal pipeline wall. When the fluid is to be transported over long distances, a significant pressure drop can result in increased pumping costs and other economical disadvantages. It therefore becomes important to minimize interaction between the viscous liquid and the internal pipeline wall to reduce pressure drop in the system. One solution to this problem is to provide a thin layer of a drag reducing material to the internal pipeline wall which "lubricates" the wall and prevents interaction with the viscous liquid.

Several apparatus have been proposed for coating or maintaining a thin layer of a drag reducing material around the internal circumference of a pipeline. The following U.S. patents are representative:

U.S. Pat. No. 1,787,126 to Steinnes teaches a device for coating the interior surface of an empty conduit in which the device contains the coating material. The device must be externally positioned in the conduit prior to expelling the material onto the conduit with compressed air.

U.S. Pat. No. 2,353,951 to Wood et al teaches coating and densifying the interior of a metallic tube by spraying the surface with colloidal graphite and then passing rollers over the surface to force penetration of the graphite into the surface and densify the metal.

U.S. Pat. No. 2,792,807 to Cummings teaches a pipe coating machine which is power driven from a point external to the pipe. This machine is only practicable for use in short pipe segments.

U.S. Pat. No. 2,821,205 to Chilton et al teaches lubricating a pipeline containing flowing heavy oil by injecting a thin film of water around the inner pipeline wall through diagonal slots in the wall. The water film is removed from the flow, through similar slots, prior to passage through a pumping station to prevent emulsification of the oil and water.

U.S. Pat. No. 3,307,567 to Gogarty et al teaches lubricating a pipeline containing a flowing petroleum product by injecting water through microporous injectors spaced along the pipeline.

U.S. Pat. No. 3,447,507 to Poettmann teaches an apparatus for depositing a low viscosity fluid along the internal surface of a pipeline in which the flow of low viscosity fluid is responsive to the pressure exerted on the apparatus by the transport fluid.

U.S. Pat. No. 3,502,103 to Verschuur teaches a pipeline inlet device for forming an annular layer of water surrounding a viscous liquid which provides for coaxial, lateral flow of the liquids prior to their actual contact in the pipeline.

None of the above prior art systems provides an effective way for applying a uniform, continuous layer of a drag reducing material on the internal wall of a pipeline over long distances.

SUMMARY OF THE INVENTION

An apparatus is provided for applying a uniform, continuous annular layer of a liquid, e.g. a drag reducing material, on the internal wall of a conduit. The liquid is applied to the conduit wall at a rate directly proportional to the rate of travel of the apparatus moving through the conduit, thereby assuring the formation of a uniform, continuous layer of the liquid. The amount of liquid to be applied can be varied by altering the mechanical components of the apparatus. The annular layer can be maintained by repeating the application at intervals determined by the breakdown of the previously applied layer of liquid.

DESCRIPTION OF THE PREFERRED EMBODIMENTS

The apparatus of the invention may be adapted for applying a layer of any liquid material on the internal wall of varying sized conduits, e.g., water pipe, sewage lines, etc. In its preferred application, however, the invention entails applying an annular layer of a drag reducing material on the internal wall of the pipeline. This preferred embodiment is set forth in the figures and following description.

Figure 1:
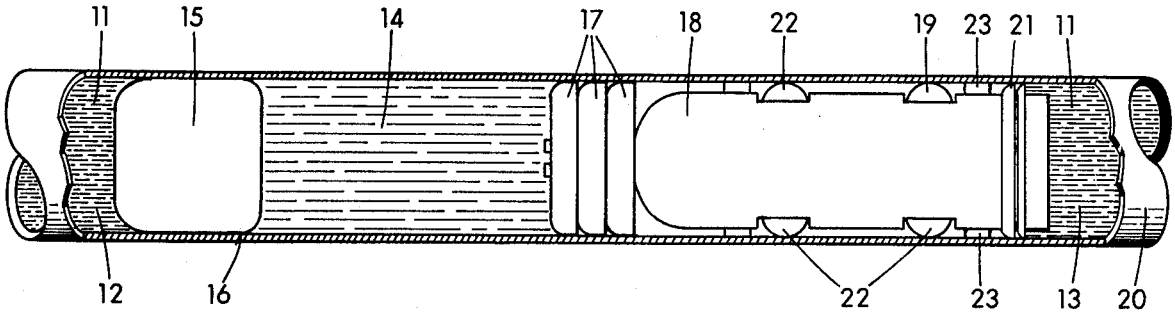
FIG. 1 is a longitudinal cross-section of a portion of a pipeline transporting a viscous liquid, a drag reducing material and one embodiment of the invention.

FIG. 1: Pipeline 20 contains a viscous liquid 11 in both the downstream 12 and upstream 13 portions of the pipeline. A drag reducing material 14 is separated from the viscous liquid by means of a separation pig (also referred to as a spacer) 15 which forms a circumferential seal with the internal wall of the pipeline 16. In this embodiment, the apparatus of the invention, hereinafter referred to as a pipeline pig or pig, includes driving cups 17 which form a circumferential seal with the internal pipeline wall and separate the drag reducing material 14 from the outside of the housing of the pig, a housing 18, a pump in the housing (not shown), a drive wheel 19 in frictional contact with the internal pipeline wall for driving the pump at a rate directly proportional to the rate of travel of the apparatus through the pipeline, and applicator wipers 21 in circumferential wiping contact with the internal pipeline wall. Stabilizing wheels 22 and pads 23 stabilize the pig as it moves through the pipeline.

Figure 2:
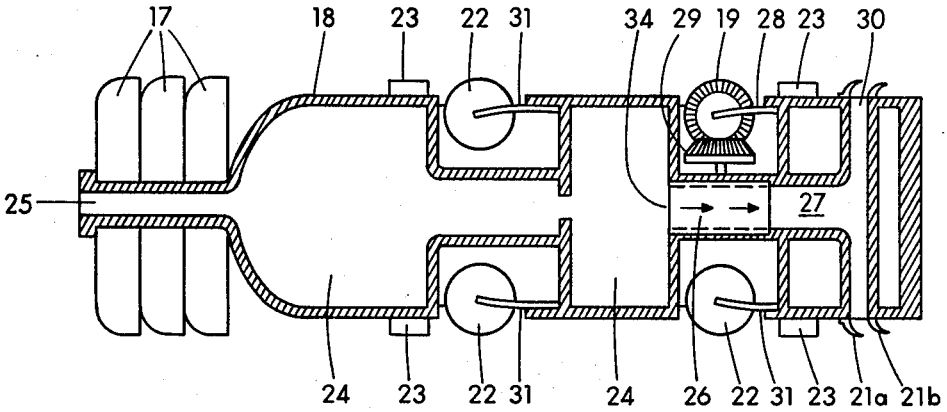
FIG. 2 is a partial cross-section of an embodiment of the invention.

A more thorough understanding of this embodiment may be obtained from the cross-section of the pipeline pig in FIG. 2. The drag reducing material enters a passageway 24 in the downstream portion of the housing 18 through a passageway 25 in driving cups 17. Existing pressure in the pipeline forces the drag reducing material upstream in the housing through passageway 24 into contact with inlet 34 to positive displacement pump 26. Pump 26, which is indicated in FIG. 2 as a box, can be any positive displacement pump which is capable of pumping the drag reducing material from downstream passageway 24 to upstream passageway 27. The direction of flow of drag reducing material through pump 26 is indicated in the drawing by arrows. The pump is driven by means responsive to the rate of travel of the pipeline pig through the pipeline. Any drive means responsive to the rate of the pig's travel is adequate for the invention. In this embodiment, the drive means includes drive wheel 19 which is urged into continuous frictional contact with the internal pipeline wall by means of single-leaf spring 28. Drive wheel 19 has beveled teeth for interaction with beveled gears 29, interconnecting the drive wheel with pump 26. As the pipeline pig moves downstream in the pipeline, the drive wheel rotates causing the pump to displace the drag reducing material from downstream passageway 24 into upstream passageway 27 and ultimately through outlet holes 30 located circumferentially around the housing underneath applicator means 21. In this embodiment, applicator means 21 is a resilient, flexible member including two sections, 21*a* and 21*b*. Sections 21*a* and 21*b* have tip portions that maintain continuous, circumferential wiping contact with the internal pipeline wall. The applicator member receives the drag reducing material from the outlet holes and wipes the drag reducing material onto the wall surface so as to maintain a desired degree of thickness and provide uniform distribution.

FIG. 2 also shows stabilizing wheels 22 and pads 23 for maintaining stability of the pig as it moves through the pipeline. Stabilizing wheels 22 are urged into continuous frictional contact with the internal pipeline wall by means of single-leaf springs 31.

Figure 3:
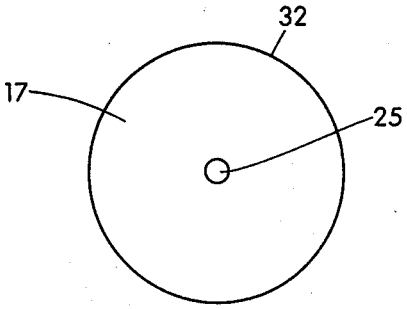
FIG. 3 is a front elevation of a driving cup for use with one embodiment of the invention.

In FIG. 3, a driving cup is shown which is suitable for use with the pipeline pig of FIG. 2. The driving cup 17 has an outer edge 32 which maintains a circumferential seal with the internal wall of the pipeline. A passageway 25 is located in the central portion of the driving cup for passage of the drag reducing material from the pipeline 14 into passageway 24 of the apparatus housing.

Since the pumping means is responsive to the rate of travel of the pig through the pipeline, a quantity of drag reducing material proportional to the pig's rate of travel is supplied to the applicator means. This results in a uniform, continuous layer of drag reducing material being applied to the pipeline wall. Of course, the quantity of material applied, i.e. the thickness of the annular layer, may be varied as desired by proper selection of pump output capacity and gearing ratios. For example, a larger output capacity pump will result in a thicker layer of drag reducing material on the wall surface. For most drag reducing materials, the optimum thickness of the annular layer will be in the range of about 0.0001 to about 0.5 inch, more preferably about 0.0005 to about 0.1 inch and most preferably about 0.001 to about 0.05 inch.

Figure 4:
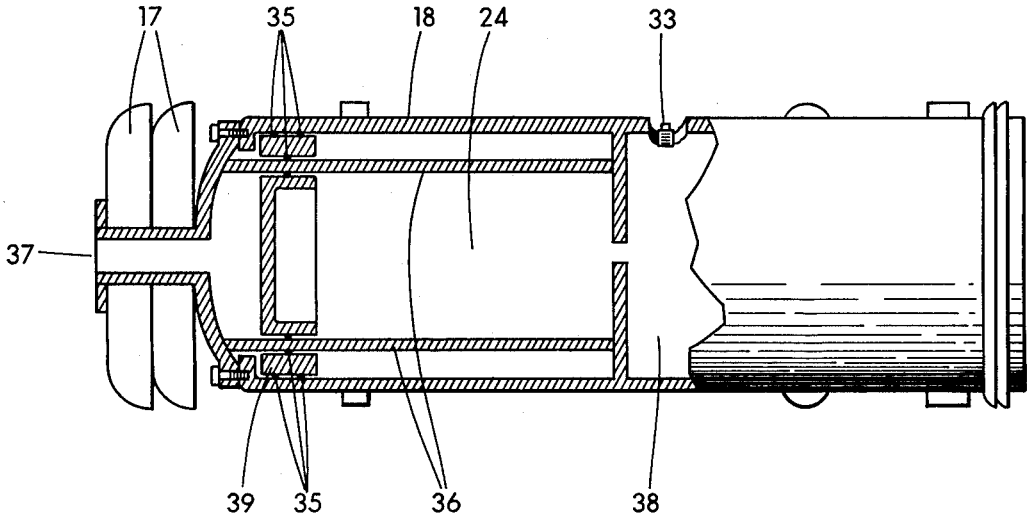
FIG. 4 is a partial cross-section of a self-contained embodiment of the invention.

An alternate embodiment of the invention is shown in FIG. 4. Here, the downstream portion of housing 18 is enclosed with the drag reducing material being contained in chamber 24 within the housing. The housing is equipped with a threaded filler plug 33, which is removable for filling chambers 24 and 38 with drag reducing material. Chamber 38 is in fluid communication with chamber 24 and pump inlet 34. To minimize pressure differential between the upstream section of the pipeline and chamber 24, a piston 39 sealed by O-rings 35 is exposed to the downstream portion of the pipeline by passageway 37. As the drag reducing material is pumped from chamber 38, the pressure differential causes the piston to slide along guide rails 36 thereby maintaining a differential pressure across the pump no greater than the pressure drop represented by the drag of the pipeline pig. Other aspects of this embodiment are similar to those described in FIG. 2. When using this embodiment of the invention, it is not necessary to insert a separation pig as shown in FIG. 1 since the drag reducing material is completely enclosed in the apparatus housing. Drive cups may be similar to those in FIG. 3.

The drag reducing material to be applied according to the present invention can be water, aqueous polymeric solutions, oil-based polymeric solutions, light liquid hydrocarbons containing fewer than 20 carbon atoms or any other liquid material that tends to reduce the drag of viscous liquids flowing through a pipeline or conduit.

The viscous liquid can be any liquid capable of being maintained in a pumpable, liquid state in the pipeline. The liquid will usually be a hydrocarbon, but can also be a liquid-solids slurry, e.g. a liquid hydrocarbon-coal slurry, liquid hydrocarbon-wax slurry or water-coal slurry, etc., or may simply be an aqueous solution. Preferably, the viscous liquid is immiscible with the drag reducing material so as to permit the liquids to be readily separated by decantation. Optimal combinations of the viscous liquid and the drag reducing material will be readily apparent to persons skilled in the art of fluid transport.

Drag reduction according to the present invention can be optimized by repeating the application of drag reducing material at intervals determined by the breakdown of the previously applied annular layer. In such a manner, the continuous annular layer of drag reducing material can be maintained throughout the length of the pipeline.

The pipeline pig can be fabricated from any suitable materials including, but not limited to, metallic alloys, plastics, rubber and combinations thereof. It is preferred that the stabilizing wheels and pads, and the external surfaces be formed from hard, wear-resistant compositions. The pipeline pig can also include optional accessories known in the art, e.g. wire brushes, scouring pads, etc.

The described embodiments are capable of a wide variety of modifications which will be readily apparent to those skilled in the art. For example, the driving cups as set forth above may be replaced with any equivalent means for forming a circumferential seal between the downstream portion of the pipeline pig and the downstream portion of the pipeline. Such variations are intended to be within the scope of the appended claims.

I claim:

1. An apparatus for applying a continuous layer of a liquid on the internal wall of a conduit during movement of the apparatus therethrough, comprising a housing smaller than the internal diameter of the conduit, having upstream and downstream ends relative to the movement of the housing through the conduit, and a passageway for the flow of the liquid therethrough; sealing means forming a circumferential seal between the internal wall of the conduit and the outside of the housing; pumping means in fluid communication with the passageway for pumping the liquid through the housing; drive means in frictional contact with said internal wall for driving the pumping means responsive to the rate of travel of the housing through the conduit; and applicator means in circumferential contact with said internal wall, located on the housing upstream from the sealing means, in fluid communication with the pumping means for receiving the liquid from the pumping means and applying the liquid on the internal wall of the conduit.

2. The apparatus of claim 1 which further comprises a chamber in the housing in fluid communication with the passageway for containing the liquid.

3. The apparatus of claim 1 in which the passageway is in fluid communication with the portion of the conduit downstream from the housing.

4. A pipeline pig for applying a continuous layer of a liquid on the internal wall of a pipeline, comprising:

a. an elongated housing smaller than the internal diameter of the pipeline, having upstream and downstream ends relative to the flow of liquid through the pipeline and a passageway for the flow of the liquid through the housing;

b. sealing means forming a circumferential seal between the outside of the housing and the internal wall of the pipeline;

c. pumping means in fluid communication with the passageway for pumping the fluid through the passageway;

d. drive means in frictional contact with said internal wall responsive to the rate of travel of the housing in the pipeline, for driving the pumping means; and e. applicator means in circumferential contact with said internal wall upstream from the sealing means and in fluid communication with the passageway for applying the liquid to the internal wall of the pipeline.

5. The pipeline pig of claim 4 which further comprises a chamber in the housing in fluid communication with the passageway for containing the liquid.

6. The pipeline pig of claim 5 wherein the sealing means comprises a plurality of driving cups in urging contact with the downstream end of the housing for simultaneous movement through the pipeline.

7. The pipeline pig of claim 4 wherein the passageway is in fluid communication with the portion of the pipeline downstream from the pig.

8. The pipeline pig of claim 7 wherein the sealing means comprises a plurality of driving cups, in urging contact with the downstream end of the housing, having a second passageway therethrough for fluid communication between the passageway in the housing and the portion of the pipeline downstream from the pig.

9. The pipeline pig of claim 4 wherein the drive means comprises a drive wheel, mounting means for mounting the drive wheel on the housing and urging the drive wheel into frictional contact with the internal wall of the pipeline, and gearing means interconnecting the drive wheel and the pumping means whereby the pump is driven in response to the rotation of the drive wheel.

10. The pipeline pig of claim 4 wherein the applicator means comprises a resilient, flexible surface mounted circumferentially around the housing and which is kept in continuous circumferential wiping contact with the internal wall of the pipeline by the resiliency of the surface, the surface being fed by fluid from the passageway.

11. The pipeline pig of claim 4 which further comprises a plurality of stabilizing pads circumferentially mounted on the outside of the housing.

12. The pipeline pig of claim 4 which further comprises a plurality of stabilizing wheels and mounting means for resiliently mounting the stabilizing wheels on the housing and urging the stabilizing wheels into continuous frictional contact with the internal wall of the pipeline.

* * * * *